US010016014B2

(12) United States Patent
Meschter et al.

(10) Patent No.: US 10,016,014 B2
(45) **Date of Patent: *Jul. 10, 2018**

(54) ARTICLE OF FOOTWEAR AND SOLE STRUCTURE WITH SENSORY NODE ELEMENTS DISPOSED ALONG SOLE PERIMETER

(71) Applicant: NIKE, Inc., Beaverton, OR (US)

(72) Inventors: James C. Meschter, Portland, OR (US); Kevin W. Hoffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/061,198

(22) Filed: Mar. 4, 2016

(65) Prior Publication Data

US 2017/0251754 A1 Sep. 7, 2017

(51) Int. Cl.
*A43B 13/12* (2006.01)
*A43B 13/26* (2006.01)
(Continued)

(52) U.S. Cl.
CPC ..... *A43B 13/181* (2013.01); *A43B 7/146* (2013.01); *A43B 13/04* (2013.01); *A43B 13/12* (2013.01);
(Continued)

(58) Field of Classification Search
CPC ..... A43B 7/148; A43B 13/00; A43B 13/12; A43B 13/26; A43B 16/18; A43B 13/18; A43C 15/168; A43C 15/14; A43C 15/144
(Continued)

(56) References Cited

U.S. PATENT DOCUMENTS 4,060,917 A 12/1977 Canale
4,271,608 A * 6/1981 Tomuro ..... A43C 15/14 36/127
(Continued)

FOREIGN PATENT DOCUMENTS

CN 201595237 U 10/2010
EP 1369048 12/2003
JP H05115308 A 5/1993

OTHER PUBLICATIONS

International Search Report and Written Opinion, dated May 24, 2017, for corresponding International Patent Application No. PCT/US2017/019173, 14 pages.
(Continued)

*Primary Examiner* — Marie Bays
(74) *Attorney, Agent, or Firm* — Klarquist Sparkman, LLP

(57) ABSTRACT

An article of footwear including a sole structure attached to an upper defining an internal void configured to receive a foot of a wearer is described. The sole structure includes a sole body portion having a plurality of sensory node elements located in apertures in the sole body portion. The sensory node elements have a bottom surface configured to contact the ground and move vertically within the apertures. The movement of sensory node element pushes a top surface of the sensory node element attached to a portion of the upper against the foot of the wearer. The sensory node element provides sensory feedback to the foot of the wearer about the condition of the ground. The sensory node elements are arranged along perimeter edges of the sole structure to provide sensory feedback along the peripheral boundaries of the foot of the wearer.

16 Claims, 12 Drawing Sheets

(51) Int. Cl.

| | |
|---|---|
| ***A43B 13/18*** | (2006.01) |
| ***A43C 15/16*** | (2006.01) |
| ***A43B 13/04*** | (2006.01) |
| ***A43B 17/00*** | (2006.01) |
| ***A43B 7/14*** | (2006.01) |
| ***A43B 13/14*** | (2006.01) |
| ***A43B 13/16*** | (2006.01) |

(52) U.S. Cl.
CPC ..... *A43B 13/122* (2013.01); *A43B 13/145* (2013.01); *A43B 13/16* (2013.01); *A43B 13/184* (2013.01); *A43B 13/187* (2013.01); *A43B 13/26* (2013.01); *A43B 17/00* (2013.01); *A43C 15/168* (2013.01)

(58) Field of Classification Search
USPC ..... 36/141, 25 R, 30 R, 31, 59 R, 61
See application file for complete search history.

(56) References Cited

U.S. PATENT DOCUMENTS 4,715,133 A * 12/1987 Hartjes ..... A43B 5/001 36/127
4,747,220 A * 5/1988 Autry ..... A43B 13/26 36/114
RE33,066 E 9/1989 Stubblefield
4,887,367 A 12/1989 Mackness et al.
4,897,936 A * 2/1990 Fuerst ..... A43B 13/223 36/114
4,972,611 A 11/1990 Swartz et al.
5,077,916 A * 1/1992 Beneteau ..... A43B 5/001 36/128
5,367,791 A * 11/1994 Gross ..... A43B 13/26 36/25 R
5,768,802 A 6/1998 Bramani
5,775,005 A * 7/1998 McClelland ..... A43B 1/0072 36/134
D397,237 S 8/1998 Teague
5,926,974 A * 7/1999 Friton ..... A43B 13/26 36/28
6,079,127 A * 6/2000 Nishimura ..... A43C 15/14 36/134
6,082,024 A 7/2000 Alberto
D448,919 S 10/2001 Montross et al.
D453,872 S 2/2002 White
6,691,432 B2 * 2/2004 Masseron ..... A43B 13/12 36/141
6,698,110 B1 * 3/2004 Robbins ..... A43B 5/185 36/134
6,739,075 B2 * 5/2004 Sizemore ..... A43B 13/182 36/61
7,069,672 B2 7/2006 Hahn
7,140,129 B2 11/2006 Clark et al.
7,313,875 B2 1/2008 Morgan
D570,584 S 6/2008 Cyrille
7,523,566 B2 * 4/2009 Young-Chul ..... A43B 13/12 36/28
7,549,236 B2 6/2009 Dillon et al.
7,681,333 B2 3/2010 Clark et al.
7,882,648 B2 2/2011 Langvin
7,954,257 B2 * 6/2011 Banik ..... A43B 7/144 36/28
7,966,748 B2 6/2011 Votolato
8,074,376 B1 12/2011 Teteriatnikov
8,079,160 B2 * 12/2011 Baucom ..... A41D 13/065 36/61
D652,614 S 1/2012 Raysse
8,256,145 B2 * 9/2012 Baucom ..... A43B 1/0018 36/61
8,341,855 B2 1/2013 Teteriatnikov
D708,831 S 7/2014 Petrie
8,763,276 B2 7/2014 Greene et al.
8,763,277 B2 7/2014 Sartor
D719,329 S 12/2014 Smith
8,914,993 B2 12/2014 Hay et al.
D723,773 S 3/2015 Raysee
D723,774 S 3/2015 Raysse
D723,788 S 3/2015 Raysse
8,984,771 B1 * 3/2015 Kramer ..... A43B 13/14 36/28
9,144,264 B2 9/2015 Marvin et al.
9,161,591 B2 10/2015 Shrairman et al.
9,603,413 B2 * 3/2017 Kramer ..... A43B 13/18
2002/0078598 A1 6/2002 Bell
2005/0188562 A1 9/2005 Clarke et al.
2007/0277401 A1 * 12/2007 Young-Chul ..... A43B 13/12 36/30 R
2009/0038180 A1 2/2009 Jacob
2009/0044432 A1 2/2009 O'Connor et al.
2011/0072684 A1 3/2011 Stubblefield
2011/0126422 A1 6/2011 Vattes et al.
2011/0138657 A1 6/2011 Christensen
2011/0192056 A1 8/2011 Geser et al.
2012/0073160 A1 3/2012 Marvin et al.
2013/0212909 A1 8/2013 Bates et al.
2014/0013617 A1 1/2014 Montross et al.
2014/0325871 A1 11/2014 Price et al.
2015/0068063 A1 3/2015 Farris
2015/0128455 A1 5/2015 Lubart
2015/0143714 A1 5/2015 Tzeng
2015/0157089 A1 6/2015 Schumacher et al.
2015/0196082 A1 7/2015 Van Atta
2015/0196087 A1 7/2015 Meschter et al.
2015/0208753 A1 7/2015 Bhupesh et al.
2015/0272271 A1 10/2015 Campos, II et al.
2015/0282561 A1 10/2015 Swager Van Dok
2015/0313310 A1 11/2015 Okamoto et al.

OTHER PUBLICATIONS

Screenshot of website https://www.youtube.com/watch?v=0Njve1rhPG8 titled "Skechers GOwalk 3 Commercial," which is identified as "Published on Jan. 19, 2015."
Taiwan Office Action, dated Nov. 28, 2017, from related Taiwanese Patent Application No. 106106963, 23 pages (with translation).

* cited by examiner

ARTICLE OF FOOTWEAR AND SOLE STRUCTURE WITH SENSORY NODE ELEMENTS DISPOSED ALONG SOLE PERIMETER

BACKGROUND

The present disclosure is directed to an article of footwear and, more particularly, to an article of footwear and a sole structure having sensory node elements located along a sole perimeter.

Conventional articles of athletic footwear include two primary elements, an upper and a sole structure. The upper provides a covering for the foot that comfortably receives and securely positions the foot with respect to the sole structure. The sole structure is secured to a lower portion of the upper and is generally positioned between the foot and the ground. In addition to attenuating ground reaction forces (that is, providing cushioning) during walking, running, and other ambulatory activities, the sole structure may influence foot motions (for example, by resisting pronation), impart stability, and provide traction, for example. Accordingly, the upper and the sole structure operate cooperatively to provide a comfortable structure that is suited for a wide variety of athletic activities.

The upper is often formed from a plurality of material elements (for example, textiles, polymer sheets, foam layers, leather, and synthetic leather) that are stitched or adhesively bonded together to define a void or cavity on the interior of the footwear for comfortably and securely receiving a foot. More particularly, the upper forms a structure that extends over instep and toe areas of the foot, along medial and lateral sides of the foot, and around a heel area of the foot. The upper may also incorporate a lacing system to adjust fit of the footwear, as well as permit entry and removal of the foot from the void within the upper. In addition, the upper may include a tongue that extends under the lacing system to enhance adjustability and comfort of the footwear, and the upper may incorporate a heel counter or other stabilizing structure.

In some cases, cushioning provided by a sole structure, while attenuating ground reaction forces, may undesirably reduce sensory feedback by isolating the foot of the wearer from the ground contact. Therefore, there exists a need in the art for a sole structure that includes provisions for increasing sensory feedback to a foot of a wearer.

SUMMARY

In one aspect, the invention provides a sole structure for an article of footwear. The sole structure comprises a sole body portion. The sole body portion includes an outsole surface facing away from the article of footwear and an upper surface disposed opposite the outsole surface. The sole structure also comprises a plurality of sensory node elements disposed within apertures in the sole body portion. The apertures can be located along portions of a lateral side perimeter edge and a medial side perimeter edge of the sole structure. Each of the plurality of sensory node elements includes a bottom surface configured to engage a ground surface and a top surface disposed opposite the bottom surface. The bottom surface of each of the sensory node elements extends above the outsole surface of the sole body portion when the sensory node element is in an uncompressed condition. Each of the plurality of sensory node elements are configured to move vertically within the apertures in the sole body portion so that the bottom surface of the sensory node element moves closer towards the outsole surface of the sole body portion when the sensory node element is in a compressed condition.

In another aspect, the invention provides an article of footwear. The article of footwear comprises an upper and a sole structure joined to the upper. The sole structure comprises a sole body portion. The sole body portion includes an outsole surface facing away from the article of footwear and an upper surface disposed opposite the outsole surface. The sole structure also comprises a plurality of sensory node elements disposed within apertures in the sole body portion. The apertures can be located along portions of a lateral side perimeter edge and a medial side perimeter edge of the sole structure. Each of the plurality of sensory node elements includes a bottom surface configured to engage a ground surface and a top surface disposed opposite the bottom surface. The bottom surface of each of the sensory node elements extending above the outsole surface of the sole body portion when the sensory node element is in an uncompressed condition. The top surface of each of the sensory node elements extending towards an interior of the upper above the upper surface of the sole body portion when the sensory node element is in a compressed condition.

Other systems, methods, features and advantages of the invention will be, or will become, apparent to one of ordinary skill in the art upon examination of the following figures and detailed description. It is intended that all such additional systems, methods, features and advantages be included within this description and this summary, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION

Figure 1:
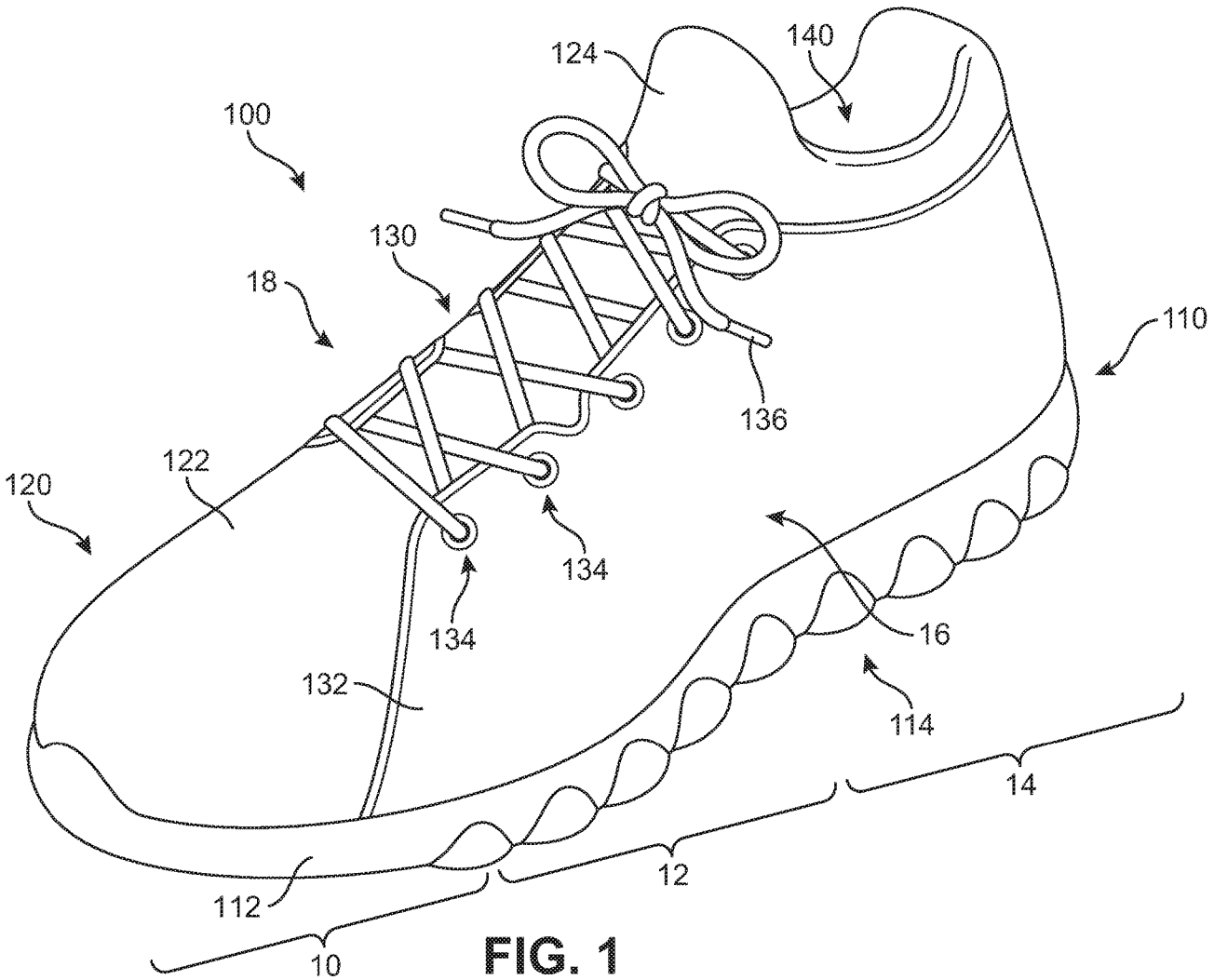
FIG. 1 is an isometric view of an article of footwear including an exemplary embodiment of a sole structure having sensory node elements disposed along perimeter edges.

The following discussion and accompanying figures disclose an article of footwear and a sole structure for an article of footwear. Concepts associated with the article of footwear disclosed herein may be applied to a variety of athletic footwear types, including skateboarding shoes, performance driving shoes, soccer shoes, running shoes, baseball shoes, basketball shoes, cross-training shoes, cycling shoes, football shoes, golf shoes, tennis shoes, walking shoes, and hiking shoes and boots, for example. The concepts may also be applied to footwear types that are generally considered to be non-athletic, including dress shoes, loafers, sandals, and work boots. Accordingly, the concepts disclosed herein apply to a wide variety of footwear types.

For consistency and convenience, directional adjectives are employed throughout this detailed description corresponding to the illustrated embodiments. The term "longitudinal," as used throughout this detailed description and in the claims, refers to a direction extending a length of a sole structure, i.e., extending from a forefoot region to a heel region of the sole structure. The term "forward" is used to refer to the general direction in which the toes of a foot point, and the term "rearward" is used to refer to the opposite direction, i.e., the direction in which the heel of the foot is facing.

The term "lateral direction," as used throughout this detailed description and in the claims, refers to a side-to-side direction extending a width of a sole structure. In other words, the lateral direction may extend between a medial side and a lateral side of an article of footwear, with the lateral side of the article of footwear being the surface that faces away from the other foot, and the medial side being the surface that faces toward the other foot.

The term "horizontal," as used throughout this detailed description and in the claims, refers to any direction substantially parallel with the ground, including the longitudinal direction, the lateral direction, and all directions in between. Similarly, the term "side," as used in this specification and in the claims, refers to any portion of a component facing generally in a lateral, medial, forward, and/or rearward direction, as opposed to an upward or downward direction.

The term "vertical," as used throughout this detailed description and in the claims, refers to a direction generally perpendicular to both the lateral and longitudinal directions. For example, in cases where a sole structure is planted flat on a ground surface, the vertical direction may extend from the ground surface upward. It will be understood that each of these directional adjectives may be applied to an article of footwear, a sole structure, and individual components of a sole structure. The term "upward" refers to the vertical direction heading away from a ground surface, while the term "downward" refers to the vertical direction heading towards the ground surface. Similarly, the terms "top," "upper," and other similar terms refer to the portion of an object substantially furthest from the ground in a vertical direction, and the terms "bottom," "lower," and other similar terms refer to the portion of an object substantially closest to the ground in a vertical direction.

For purposes of this disclosure, the foregoing directional terms, when used in reference to an article of footwear, shall refer to the article of footwear when sitting in an upright position, with the sole facing groundward, that is, as it would be positioned when worn by a wearer standing on a substantially level surface.

FIGS. 1 through 9 illustrate an exemplary embodiment of an article of footwear 100, also referred to simply as article 100. In some embodiments, article of footwear 100 may include a sole structure 110 and an upper 120. For reference purposes, article 100 may be divided into three general regions: a forefoot region 10, a midfoot region 12, and a heel region 14, as shown in FIGS. 1-6. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14 and lateral side 16, medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. Upper 120 defines an interior void within article 100 for receiving and securing a foot relative to sole structure 110. The void is shaped to accommodate the foot and extends along a lateral side of the foot, along a medial side of the foot, over the foot, around the heel, and under the foot. Upper 120 may also include a collar that is located in at least heel region 14 and forms a throat opening 140. Access to the interior void of upper 120 is provided by throat opening 140. More particularly, the foot may be inserted into upper 120 through throat opening 140, and the foot may be withdrawn from upper 120 through throat opening 140.

In an exemplary embodiment, upper 120 may be formed from a bootie 122. Bootie 122 can be a one-piece element that entirely covers the top, sides and bottom of a foot of a wearer. The various portions of upper 120, including bootie 122, may be formed from one or more of a plurality of material elements (e.g., textiles, polymer sheets, foam layers, leather, synthetic leather) that can form the majority of upper 120 or portions can be stitched or bonded together to form upper 120 defining the void within article 100. In one embodiment, bootie 122 can form a majority of an exterior surface of upper 122. In other embodiments, upper 120 may be a conventional upper formed by multiple material element portions and can include edges that are attached to a sockliner or strobel sock to extend under the foot and close the interior void of the upper 120.

In some embodiments, article 100 can include a lacing system 130. Lacing system 130 extends forward from collar and throat opening 140 in heel region 14 over an area corresponding to an instep of the foot in midfoot region 12 to an area adjacent to forefoot region 10. Lacing system 130 includes various components configured to secure a foot within upper 120 of article 100 and, in addition to the components illustrated and described herein, may further include additional or optional components conventionally included with footwear uppers. In this embodiment, a lace 136 extends through various lace-receiving elements to permit the wearer to modify dimensions of upper 120 to accommodate the proportions of the foot. In the exemplary embodiments, lace-receiving elements are configured as a plurality of lace apertures 134. More particularly, lace 136 permits the wearer to tighten upper 120 around the foot, and lace 136 permits the wearer to loosen upper 120 to facilitate entry and removal of the foot from the interior void (i.e., through ankle opening 140). Lace 136 is shown in FIG. 1, but has been omitted from the remaining Figures for ease of illustration of the remaining components of article 100.

As an alternative to plurality of lace apertures 134, upper 120 may include other lace-receiving elements, such as loops, eyelets, and D-rings. In addition, upper 120 includes a tongue 124 that extends over a foot of a wearer when disposed within article 100 to enhance the comfort of article 100. In this embodiment, tongue 124 is integrally formed with bootie 122. In other embodiments, tongue 124 may be an individual component that may move within an opening between opposite lateral and medial sides of upper 120.

In one embodiment, lacing system 130 may further include a support wrap 132. Support wrap 132 extends over the outside of bootie 122 and includes lace apertures 134. In exemplary embodiments, support wrap 132 extends between a lower area of upper 120 where upper 120 and sole structure 110 are joined and a lacing area where lace 136 extends through lace apertures 134 over the top of upper 120. With this configuration, lace apertures 134 of lacing system 130 may be provided on support wrap 132 separate from bootie 122 to allow bootie 122 to have a construction without any lace-receiving elements. In other embodiments, one or more lace-receiving elements, including lace apertures 134, may be located instead, or additionally, on bootie 122 of upper 120.

In some embodiments, sole structure 110 may include multiple components, which may individually and/or collectively provide article 100 with a number of attributes, such as support, rigidity, flexibility, stability, cushioning, comfort, reduced weight, traction, and/or other attributes. In various athletic activities, execution of skills involved in such athletic activities may be performed based on precise placement and interaction of the wearer's feet with the surface on which the activities are performed. Therefore, typical cushioning found in the sole structure of footwear used in such activities may reduce the amount of sensory feedback that the wearer can feel from the surface through the soles of the footwear. This can adversely affect their ability to position their feet and interact with the surface on which the activity is performed. For example, in sports and other athletic activities where weight transfer or cutting motions are commonly performed, sensory feedback to the wearer's foot about the condition of the surface and the amount of grip or force being applied at various locations across the wearer's foot can be helpful to the wearer.

In an exemplary embodiment, article 100 includes sole structure 110 having a sole body portion 112 and a plurality of sensory node elements 114. Plurality of sensory node elements 114 are located along perimeter edges of sole structure 110 to provide sensory feedback to a wearer's foot about peripheral boundaries for assisting with athletic activities.

In exemplary embodiments, components of sole structure 110 may be formed of suitable materials for achieving the desired performance attributes. Sole body portion 112 may be formed of any suitable rubber, polymer, composite, and/or metal alloy materials. Exemplary materials may include thermoplastic and thermoset polyurethane, polyester, nylon, polyether block amide, alloys of polyurethane and acrylonitrile butadiene styrene, carbon fiber, poly-paraphenylene terephthalamide (para-aramid fibers, e.g., Kevlar®), titanium alloys, and/or aluminum alloys. In some embodiments, sole body portion 112 may be fashioned from a durable and wear-resistant material (for example, rubber). Other suitable materials will be recognized by those having skill in the art.

In some embodiments, plurality of sensory node elements 114 may be made of similar materials as sole body portion 112, including any of the materials suitable for sole structure 110, described above. In an exemplary embodiment, plurality of sensory node elements 114 may be made from a material that has a lower density or lesser hardness than sole body portion 112. For example, in some embodiments, plurality of sensory node elements 114 may be formed from a resilient polymer foam material, such as polyurethane (PU) or ethyl vinyl acetate (EVA). In other embodiments, plurality of sensory node elements 114 may be formed from a less dense rubber or polymer material than sole body portion 112. In still other embodiments, plurality of sensory node elements 114 and sole body portion 112 may be formed by the same material.

Figure 2:
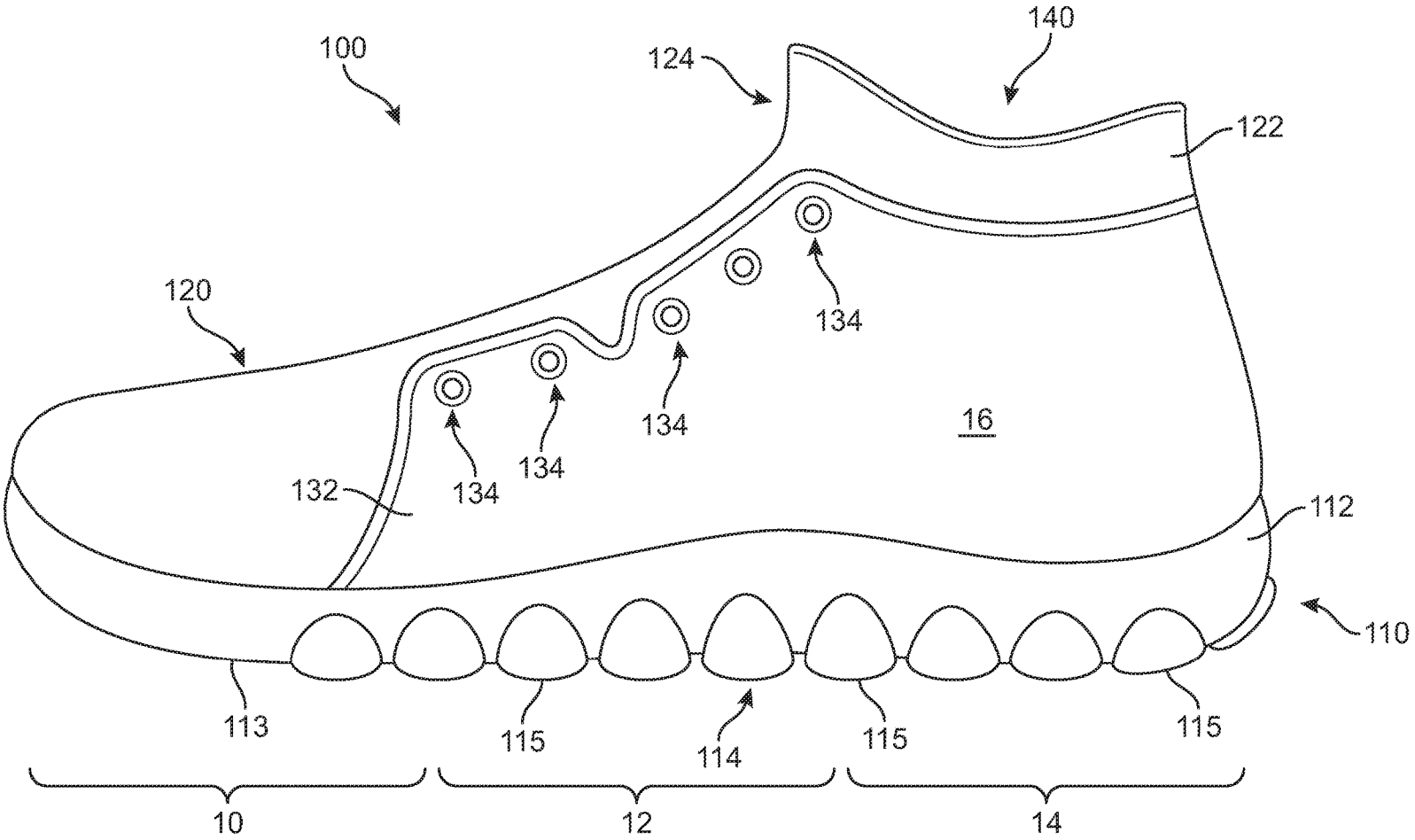
FIG. 2 is a lateral side view of the article of footwear including an exemplary embodiment of a sole structure having sensory node elements disposed along perimeter edges.
Figure 3:
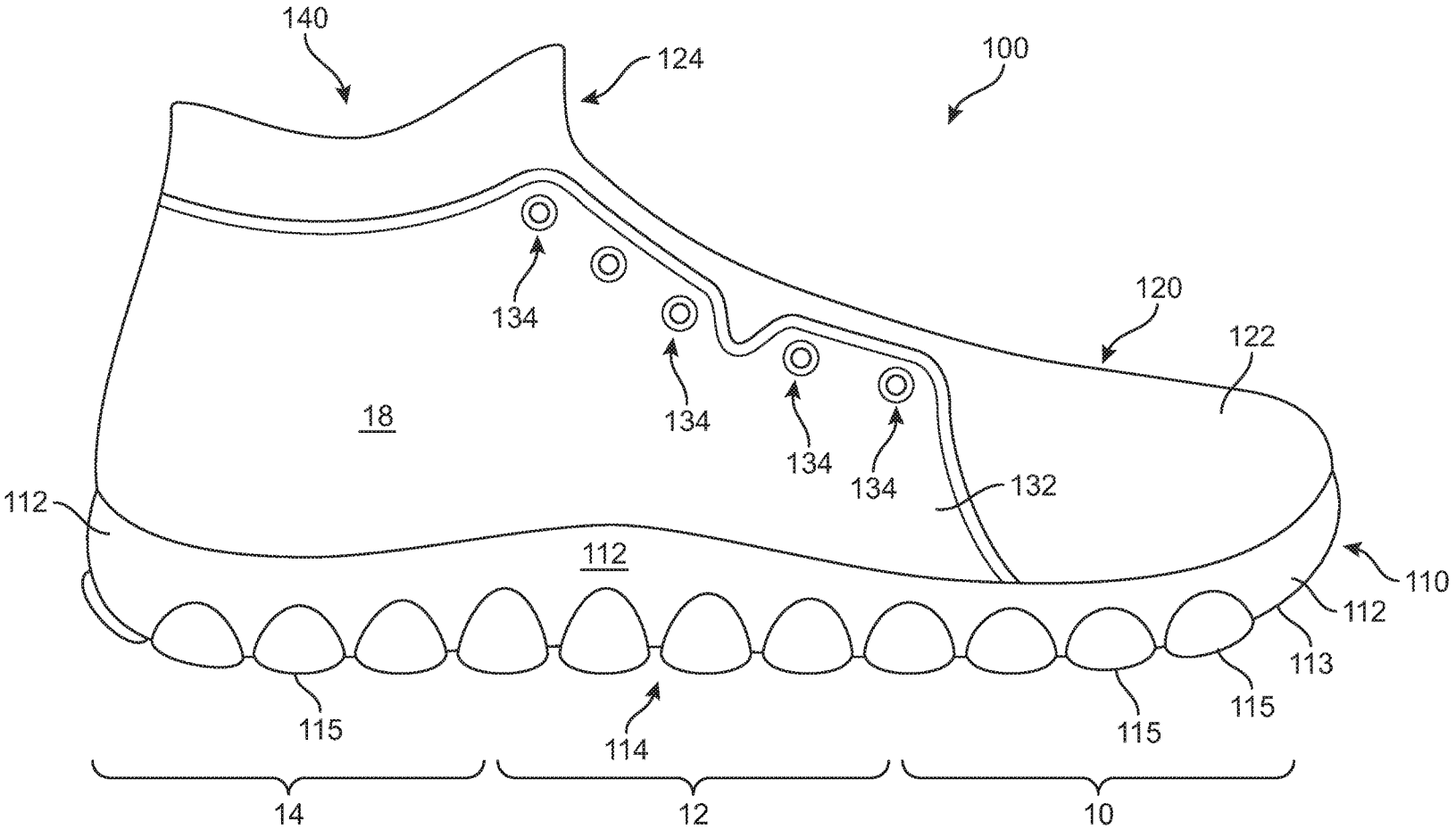
FIG. 3 is a medial side view of the article of footwear including an exemplary embodiment of a sole structure having sensory node elements disposed along perimeter edges.

FIGS. 1-3 illustrate different views of article 100. As shown in FIG. 1, sole structure 110 may include a plurality of sensory node elements 114. Sensory node elements 114 may be exposed through apertures 600 (shown in FIGS. 6-11) in sole body portion 112. Accordingly, a portion of plurality of sensory node elements 114 may be exposed to the exterior of article 100 and configured to contact the ground. In this embodiment, a bottom surface 115 of plurality of sensory node elements 114 is oriented to be the ground-engaging surface of plurality of sensory node elements 114. An opposite top surface 116 (shown in FIG. 5) of plurality of sensory node elements 114 is disposed facing away from the ground and towards the interior of upper 120.

In an exemplary embodiment, sole body portion 112 includes a lower outsole surface 113 that is also exposed to the exterior of article 100 and configured to contact the ground. An opposite upper surface 111 of sole body portion 112 is disposed facing away from the ground and towards the interior of upper 120, in a similar orientation as top surface 116 of plurality of sensory node elements 114.

In some embodiments, sole structure 110 includes plurality of sensory node elements 114 that are arranged along perimeter edges of different regions and/or portions of article 100 to provide sensory feedback along the peripheral boundaries of the wearer's foot. That is, by providing plurality of sensory node elements 114 along perimeter edges of sole structure 110, sensory feedback regarding the location of the medial and lateral sides of the foot in relation to the perimeter edges of sole structure 110 and article 100 can be provided. This type of sensory feedback may be helpful in assisting a wearer in determining whether a foot is centered or well-placed over the sole structure of the article of footwear before making any additional athletic moves or motions. For example, sensory feedback from plurality of sensory node elements 114 may alert the wearer that his or her foot has reached the perimeter edge of sole structure 110 so that any further movement or transfer of weight onto that foot may cause an unstable or unbalanced condition from not having the foot adequately supported by underlying sole structure 110. Additionally, plurality of sensory node elements 114 can also provide a "push-off" surface for a wearer's foot within an interior of the article of footwear.

In the exemplary embodiment shown in FIGS. 1-9, plurality of sensory node elements 114 are located along perimeter edges of sole structure 110 within various portions of each of forefoot region 10, midfoot region 12, and heel region 14. Additionally, the locations of plurality of sensory node elements 114 may be varied between lateral side 16 and medial side 18. Referring to FIG. 2, lateral side 16 of article 100 is illustrated. In this embodiment, plurality of sensory node elements 114 are disposed along the lateral perimeter edge of sole structure 110 within portions of each of forefoot region 10, midfoot region 12, and heel region 14. The remaining portion of sole structure 110 extending forward to the toe area of article 100 is formed by sole body portion 112.

Referring now to FIG. 3, medial side 18 of article 100 is illustrated. In this embodiment, plurality of sensory node elements 114 are disposed within each of forefoot region 10, midfoot region 12, and heel region 14. Compared with lateral side 16, plurality of sensory node elements 114 on medial side 18 extend further towards the toe area of article 100 in forefoot region 10 of sole structure 110. In addition, plurality of sensory node elements 114 on medial side 18 extend along substantially the entire medial perimeter edge of sole structure 110 from the rear end of article 100 at heel region 14 to the toe end of article 100 at forefoot region 10.

While the Figures illustrates an embodiment that provides sensory node elements disposed along perimeter edges within all regions of the foot, in some embodiments, sole structure 110 may include sensory node elements disposed only partially along perimeter edges corresponding to some portions of the foot and not others. For example, in some embodiments, sensory node elements may be provided only along perimeter edges in forefoot region 10 of article 100. In other embodiments, sensory node elements may be provided along perimeter edges in forefoot region 10 and heel region 14, but not in midfoot region 12 of article 100.

In different embodiments, the sizing of the sensory node elements may vary in order to provide desired performance for the activity for which article 100 is to be used. In an exemplary embodiment, each of the plurality of sensory node elements 114 may be substantially the same size. The size of plurality of sensory node elements 114 may be selected so as to be sufficiently large to provide sensory feedback to a wearer's foot. In one embodiment, plurality of sensory node elements 114 may have a diameter of approximately 1 inch. An exemplary range of diameters that are suitable for providing sensory feedback may be approximately from 0.75 inches to 1.25 inches. In some cases, the diameter may be larger or smaller. In other embodiments, the size of each of the plurality of sensory node elements 114 may be different, depending on the sensitivity of the portion of the foot where sensory feedback is desired. For example, in locations where the foot is more sensitive, a smaller diameter sensory node element may be provided, whereas in locations where the foot is less sensitive, a larger diameter sensory node element can be provided to increase the ability of the sensory node element to effectively provide sensory feedback to the wearer's foot. Further, the density or proximity of sensory node elements to one another may also vary according to performance and sensitivity considerations.

Figure 4:
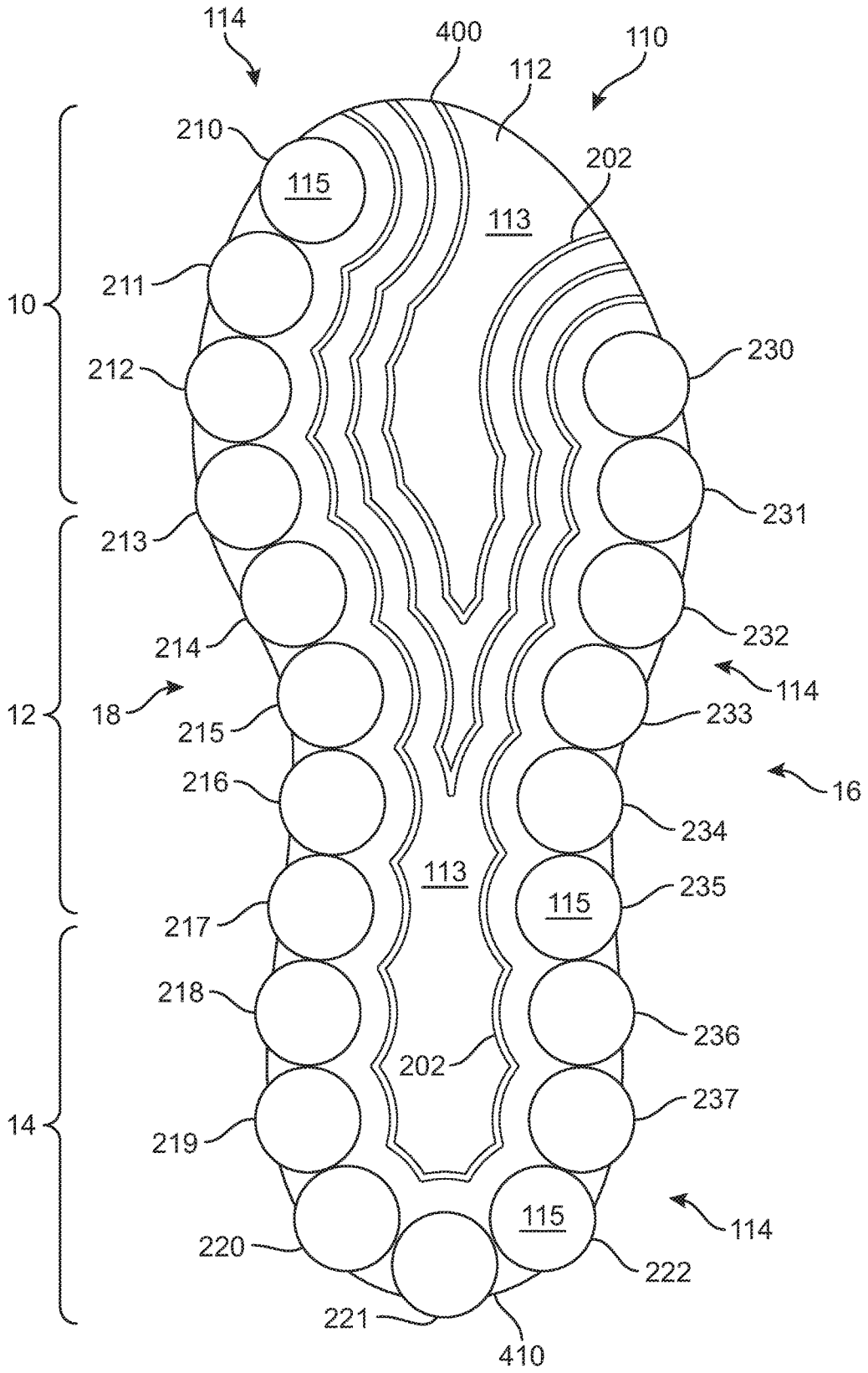
FIG. 4 is a bottom view of the exemplary embodiment of a sole structure having sensory node elements disposed along perimeter edges.

FIG. 4 illustrates a bottom view of the underside of sole structure 110 of article 100. Sole structure 110 extends along a longitudinal length of article 100 between a toe end 400 located at the front of forefoot region 10 to a heel end 410 located at the rear of heel region 14. In an exemplary embodiment, plurality of sensory node elements 114 are located along the perimeter edges of lateral side 16 and medial side 18 within each of forefoot region 10, midfoot region 12, and heel region 14.

In some embodiments, a first set of the plurality of sensory node elements 114 can extend along a medial perimeter edge on medial side 18. In this embodiment, the first set of sensory node elements 114 includes a first sensory node element 210, a second sensory node element 211, a third sensory node element 212, a fourth sensory node element 213, a fifth sensory node element 214, a sixth sensory node element 215, a seventh sensory node element 216, an eighth sensory node element 217, a ninth sensory node element 218, and a tenth sensory node element 219 that extend along the medial perimeter edge on medial side 18. As shown in FIG. 4, first sensory node element 210 is disposed near toe end 400 of sole structure 110 and tenth sensory node element 219 is disposed rearward near heel end 410 in heel region 14. The remaining sensory node elements in the first set of the plurality of sensory node elements 114 extend along the medial perimeter edge of sole structure 110 in the longitudinal direction between first sensory node element 210 and tenth sensory node element 219.

In an exemplary embodiment, a second set of the plurality of sensory node elements 114 extend along a lateral perimeter edge on lateral side 16. In this embodiment, the second set of sensory node elements 114 includes an eleventh sensory node element 230, a twelfth sensory node element 231, a thirteenth sensory node element 232, a fourteenth sensory node element 233, a fifteenth sensory node element 234, a sixteenth sensory node element 235, a seventeenth sensory node element 236, and an eighteenth sensory node element 237 that extend along the lateral perimeter edge on lateral side 16. As shown in FIG. 4, eleventh sensory node element 230 is disposed in forefoot region 10 spaced apart from toe end 400 of sole structure 110 and eighteenth sensory node element 237 is disposed rearward near heel end 410 in heel region 14. The remaining sensory node elements in the second set of the plurality of sensory node elements 114 extend along the lateral perimeter edge of sole structure 110 in the longitudinal direction between eleventh sensory node element 230 and eighteenth sensory node element 237.

In an exemplary embodiment, the first set of plurality of sensory node elements 114 on medial side 18 include a greater number of sensory node elements than the second set of plurality of sensory node elements 114 on lateral side 16. Additionally, as can be seen in FIG. 4, first sensory node element 210 and second sensory node element 211 both extend farther along the medial perimeter edge in the longitudinal direction and closer to toe end 400 of sole structure 110 than eleventh sensory node element 230 on the lateral perimeter edge on lateral side 16. With this arrangement, first sensory node element 210 and second sensory node element 211 may be located near a big toe of a foot of a wearer on the medial perimeter edge of medial side 18 of sole structure 110 to provide sensory feedback to the foot of a wearer. In many sports or athletic motions, sensory feedback from the big toe of the foot of a wearer can be helpful in performing the sport or athletic motion. By providing sensory node elements, such as first sensory node element 210 and second sensory node element 211, in the location corresponding to the big toe, helpful sensory feedback can be provided to the wearer.

In an exemplary embodiment, another set of the plurality of sensory node elements 114 can be located within heel region 14 and extend in a lateral direction across the sole structure 110. In this embodiment, the heel set of plurality of sensory node elements 114 includes a nineteenth sensory node element 220, a twentieth sensory node element 221, and a twenty-first sensory node element 222 located at heel end 410 and extending around from medial side 18 to lateral side 16 in heel region 14. With this arrangement, this heel set of plurality of sensory node elements 114 located in heel region 14 of sole structure 110 can provide sensory feedback to the heel of a foot of a wearer.

In one embodiment, the arrangement of sets of plurality of sensory node elements 114 along the medial perimeter edge and the lateral perimeter edge on sole structure 110 may be separated by sole body portion 112 extending in between. For example, outsole surface 113 of sole body portion 112 may be exposed between the first set of plurality of sensory node elements on medial side 18 and the second set of plurality of sensory node elements on lateral side 16 of sole structure 110. In some embodiments, outsole surface 113 may further include additional features that assist with providing traction to sole structure 110. In one embodiment, a plurality of grooves 202 is disposed in outsole surface 113 of sole body portion 112. Plurality of grooves 202 can be depressions or recesses in sole body portion 112 that extend below surrounding outsole surface 113. In this embodiment, plurality of grooves 202 is arranged in an approximately concentric arrangement, with each groove being substantially evenly spaced apart from adjacent grooves. With this configuration, outsole surface 113 of sole body portion 112 may assist with providing traction or grip to article 100.

Figure 5:
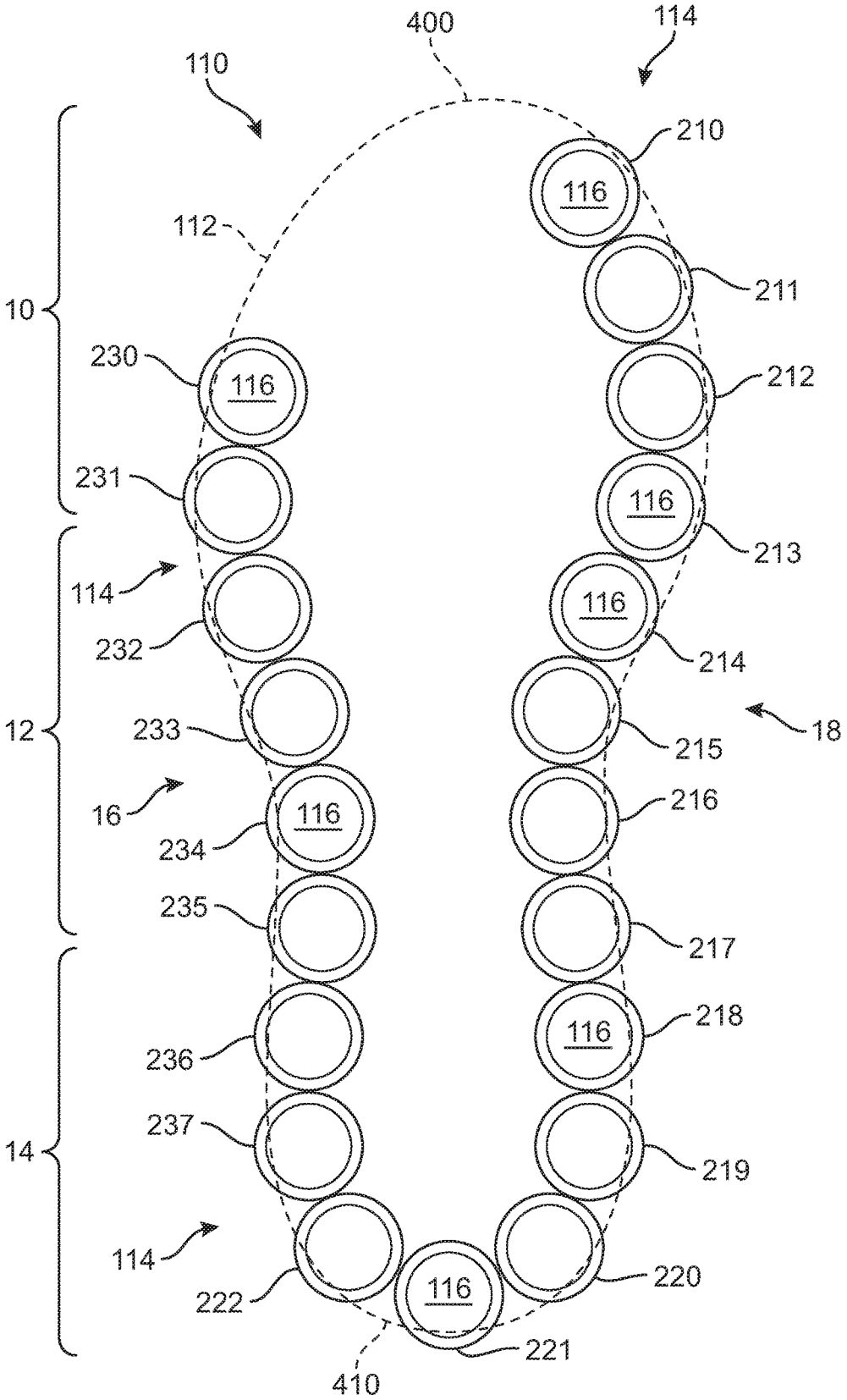
FIG. 5 is a schematic top down view showing the locations of the sensory node elements with the remaining portion of the sole structure shown in outline.

FIG. 5 illustrates an interior top down view of the inner side of sole structure 110 of article 100, with upper 120 and sole body portion 112 shown in outline. In some embodiments, each of plurality of sensory node elements 114 may have a top surface 116 located at a top end where each sensory node element has a smaller diameter than an opposite bottom end where bottom surface 115 is located. As will be further described below, top surface 116 of each of plurality of sensory node elements 114 is attached to a base layer 128 of upper 120. In this case, base layer 128 is a bottom portion of bootie 122 that extends under a foot of a wearer. In other cases, where article 100 includes other embodiments of upper 120, base layer 128 may be formed by a sockliner, a strobel sock, or an insole that encloses upper 120.

Figure 6:
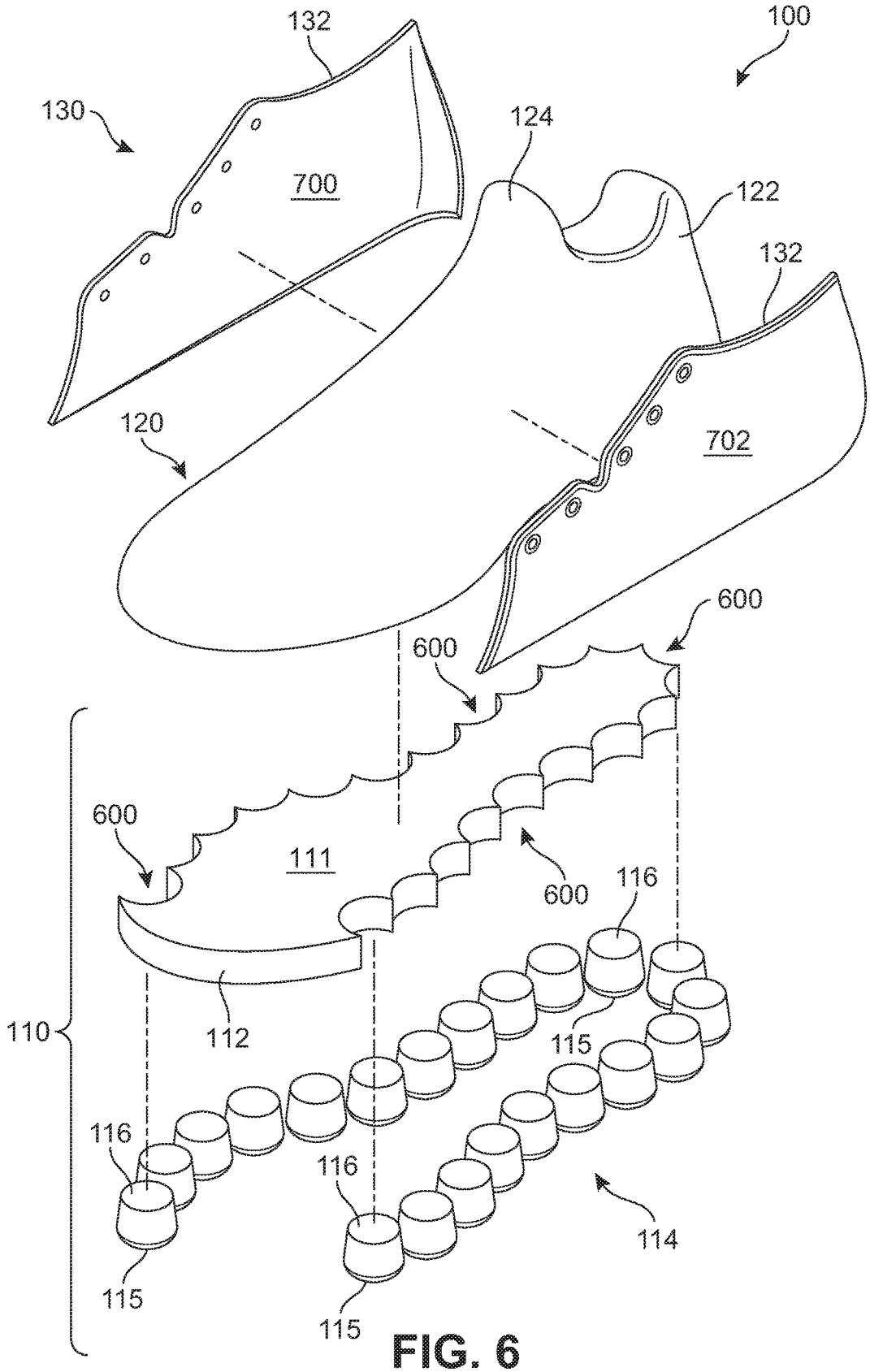
FIG. 6 is an exploded schematic view of the article of footwear including an exemplary embodiment of a sole structure having sensory node elements disposed along perimeter edges.

FIG. 6 illustrates an exploded isometric view of article 100, including components of each of sole structure 110, upper 120, and lacing system 130. As shown in FIG. 6, sole structure 110 includes plurality of sensory node elements 114 and sole body portion 112. Sole body portion 112 includes apertures 600 that receive plurality of sensory node elements 114. Apertures 600 permit top surface 116 of plurality of sensory node elements 114 to be attached to upper 120 and allow for independent movement of plurality of sensory node elements 114 from sole body portion 112 when bottom surface 115 of plurality of sensory node elements 114 contact a surface.

In an exemplary embodiment, the arrangement of various sets of plurality of sensory node elements 114 along the medial perimeter edge and the lateral perimeter edge of sole structure 110 may be separated by sole body portion 112, as described above. In this embodiment, sole body portion 112 includes apertures 600 disposed along each of the medial perimeter edge on medial side 18 of sole structure 110, the lateral perimeter edge on lateral side 16 of sole structure 110, and extending from medial side 18 to lateral side 16 around heel end 410 at the rear of sole structure 110.

In other embodiments, apertures 600 can each correspond to a single one of plurality of sensory node elements 114, or apertures 600 may be configured to receive multiple sensory node elements of plurality of sensory node elements 114. In some cases, a combination of apertures 600 may be used at different portions of sole structure 110 so that some apertures 600 include one sensory node element, while other apertures 600 include multiple sensory node elements.

Referring again to FIG. 6, in some embodiments, support wrap 132 of lacing system 130 may be provided by separate components for each of lateral side 16 and medial side 18 of upper 120. In this embodiment, support wrap includes a medial support portion 700 on medial side 18 and a lateral support portion 702 on lateral side 16. Together, medial support portion 700 and lateral support portion 702 form support wrap 132 and include plurality of lace apertures 134 for receiving lace 136. Support wrap 132 extends over the outside of bootie 122 and assists with fastening article 100 to a foot of a wearer. Support wrap 132, including each of medial support portion 700 and lateral support portion 702, may be joined to portions of sole structure 110, portions of upper 120, or both.

Figure 7:
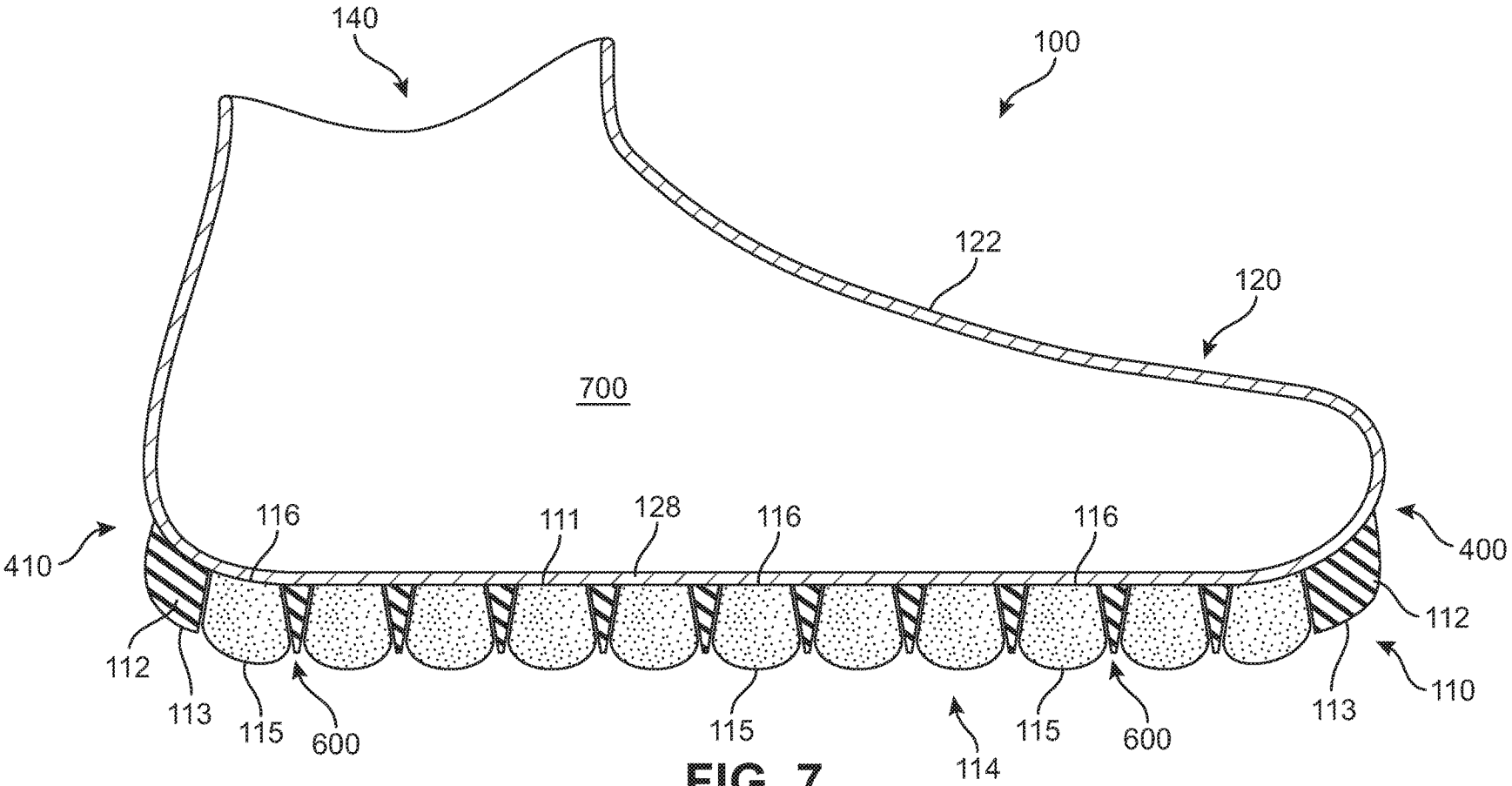
FIG. 7 is a representational cross-section view of the article of footwear including an exemplary embodiment of a sole structure having sensory node elements disposed along perimeter edges.
Figure 8:
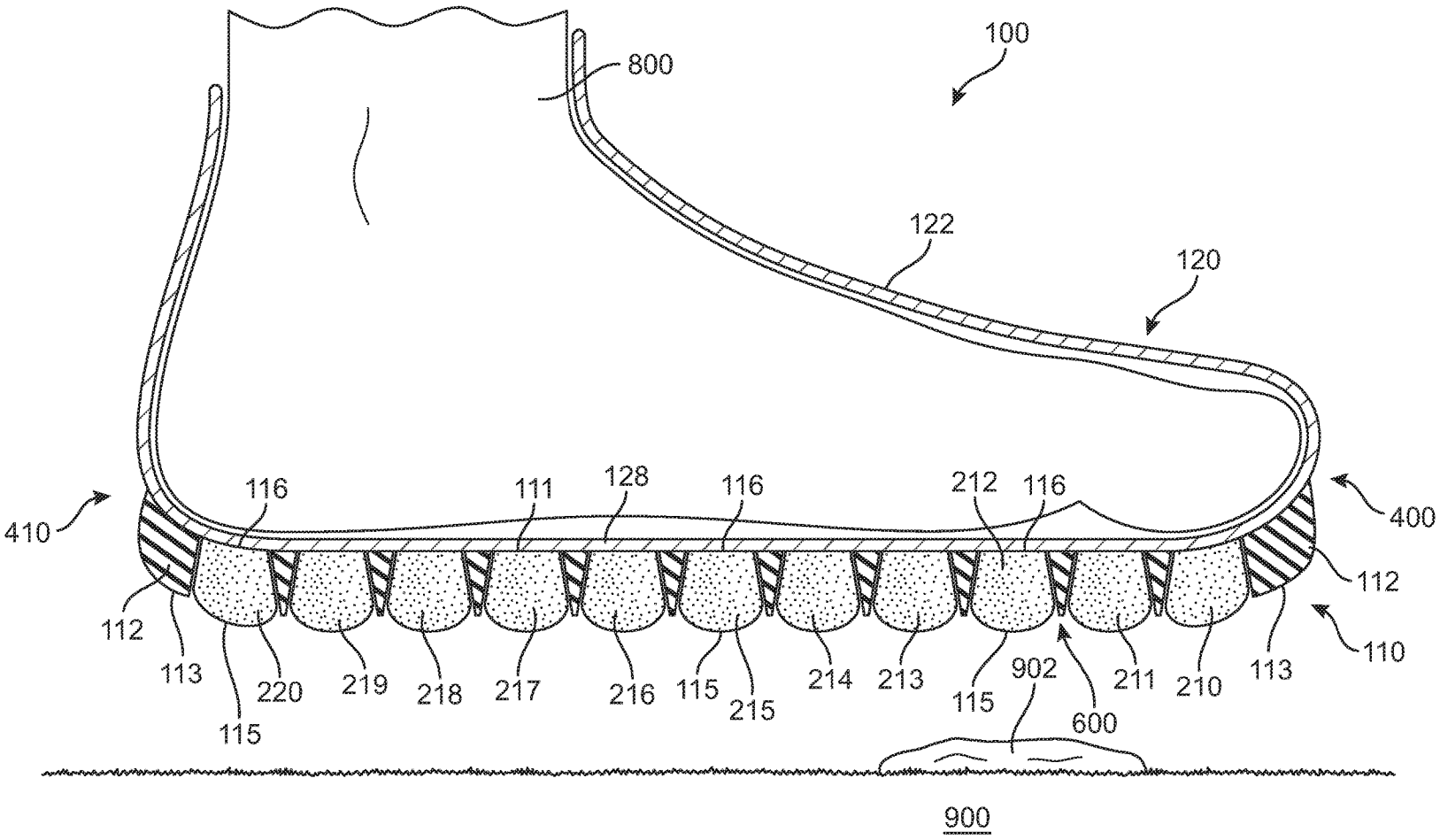
FIG. 8 is a representational cross-section view of a foot within the article of footwear with sensory node elements in an uncompressed condition.
Figure 9:
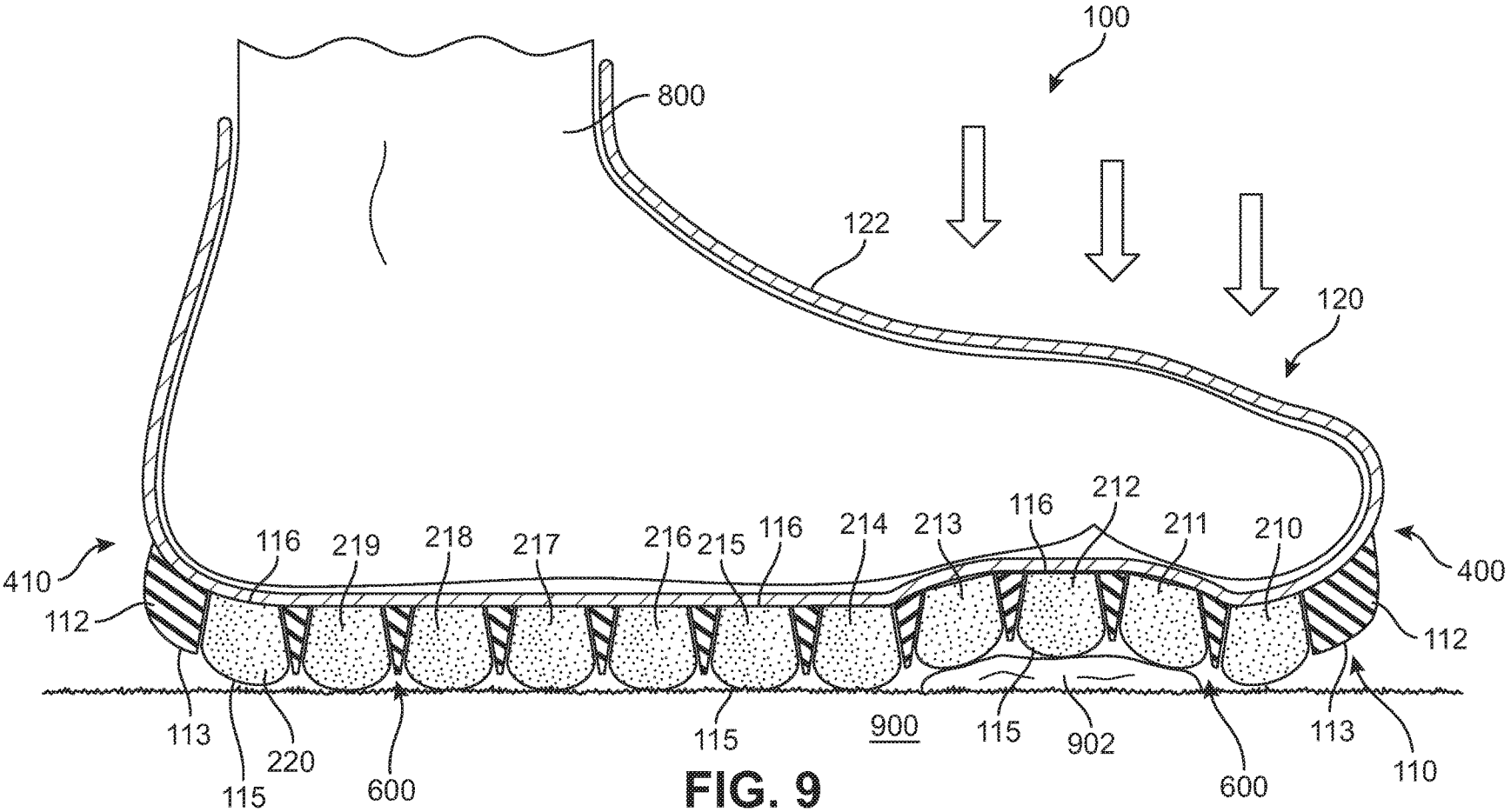
FIG. 9 is a representational cross-section view of a foot within the article of footwear with sensory node elements in an compressed condition.

FIGS. 7-9 provide an exemplary representational illustration of sensory feedback provided to a foot of a wearer by sole structure 110 and plurality of sensory node elements 114. In some embodiments, bootie 122 forming upper 120 can be joined to sole body portion 112 and plurality of sensory node elements 114. As shown in FIG. 7, base layer 128 is a bottom portion of bootie 122 that is configured to extend under a foot of a wearer. Base layer 128 is joined to upper surface 111 of sole body portion 112 and also joined to top surface 116 of plurality of sensory node elements 114. In this embodiment, each sensory node element of plurality of sensory node elements 114 is shown within a respective aperture of apertures 600 in sole body portion 112. This arrangement allows top surface 116 of each of plurality of sensory node elements 114 to be attached to base layer 128 of bootie 122. Additionally, plurality of sensory node elements 114 are not attached or joined to sole body portion 112 so that plurality of sensory node elements 114 are permitted to wobble and independently move in at least a vertical direction within apertures 600 in sole body portion.

Referring now to FIG. 8, foot 800 is shown disposed with the interior void of upper 120 in article 100. The bottom of foot 800 is in contact with various portions of base layer 128. Article 100 is shown here in an uncompressed condition before article 100 is placed in contact with a ground surface 900. In this uncompressed condition, each of plurality of sensory node elements 114 has top surface 116 that is approximately flush or even with upper surface 111 of sole body portion 112. Plurality of sensory node elements 114, including first sensory node element 210, second sensory node element 211, third sensory node element 212, fourth sensory node element 213, a fifth sensory node element 214, sixth sensory node element 215, seventh sensory node element 216, eighth sensory node element 217, ninth sensory node element 218, tenth sensory node element 219, and nineteenth sensory node element 220, are shown within apertures 600 in sole body portion 112 in an uncompressed condition along the medial perimeter edge on medial side 18.

As foot 800 wearing article 100 steps onto ground surface 900, article 100 is placed in a compressed condition. Referring now to FIG. 9, article 100 is shown being compressed by foot 800 against ground surface 900. In various cases, ground surface 900 may have one or more objects or uneven features. In this embodiment, ground surface 900 includes a first object 902. First object 902 can be a rock, debris, or any other change in surface topology of ground surface 900, such as a hill, mound, divot, or depression.

In this embodiment, when article 100 is in the compressed condition, one or more of plurality of sensory node elements 114 can transmit or relay sensory feedback regarding the condition or topology of ground surface 900 through sole structure 110 to foot 800. As shown in FIG. 9, first object 902 on ground surface 900 can push each of second sensory node element 211, third sensory node element 212, and fourth sensory node element 213 upwards through apertures 600 in sole body portion 112. This upwards vertical motion of second sensory node element 211, third sensory node element 212, and fourth sensory node element 213 causes top surface 116 to push base layer 128 upwards and contact foot 800 in the area corresponding to the location of first object 902 on ground surface 900. With this sensory feedback, a wearer can feel that there is an object or uneven area of ground surface 900 that is disposed along the medial perimeter edge of forefoot region 10 on medial side 18 of article 100.

By providing sole structure 110 of article 100 with plurality of sensory node elements 114 disposed along perimeter edges of sole structure 110 that corresponds generally with the peripheral boundaries of a foot of a wearer, sensory feedback may be similarly provided to the respective portions of the foot and give the wearer information about the condition or topology of the ground surface in contact with sole structure 110 of article 100. This type of sensory feedback may be helpful in assisting a wearer in determining whether a foot is centered or well-placed over sole structure 110 of article of footwear 100 before making any additional athletic moves or motions on an uneven or unstable ground surface 900. For example, sensory feedback from second sensory node element 211, third sensory node element 212, and fourth sensory node element 213 in forefoot region 10 of the medial perimeter edge on medial side 18 may alert the wearer that foot 800 has reached the perimeter edge of sole structure 110 so that any further movement or transfer of weight onto foot 800 may cause an unstable or unbalanced condition on ground surface 900 from not having foot 800 adequately supported by underlying sole structure 110. Additionally, plurality of sensory node elements 114 underlying the foot of the wearer can provide a "push off" surface for the foot within the interior of the article of footwear to assist with making athletic maneuvers or cutting motions.

Figure 10:
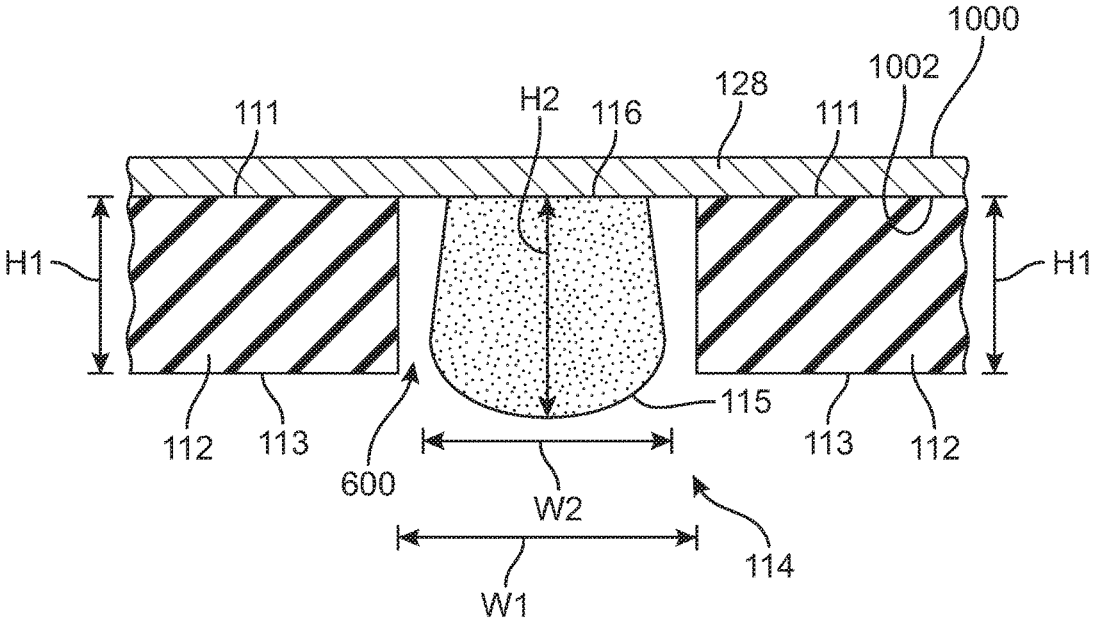
FIG. 10 is an enlarged cross-section view of a sensory node located within an aperture in the sole structure in an uncompressed condition.
Figure 11:
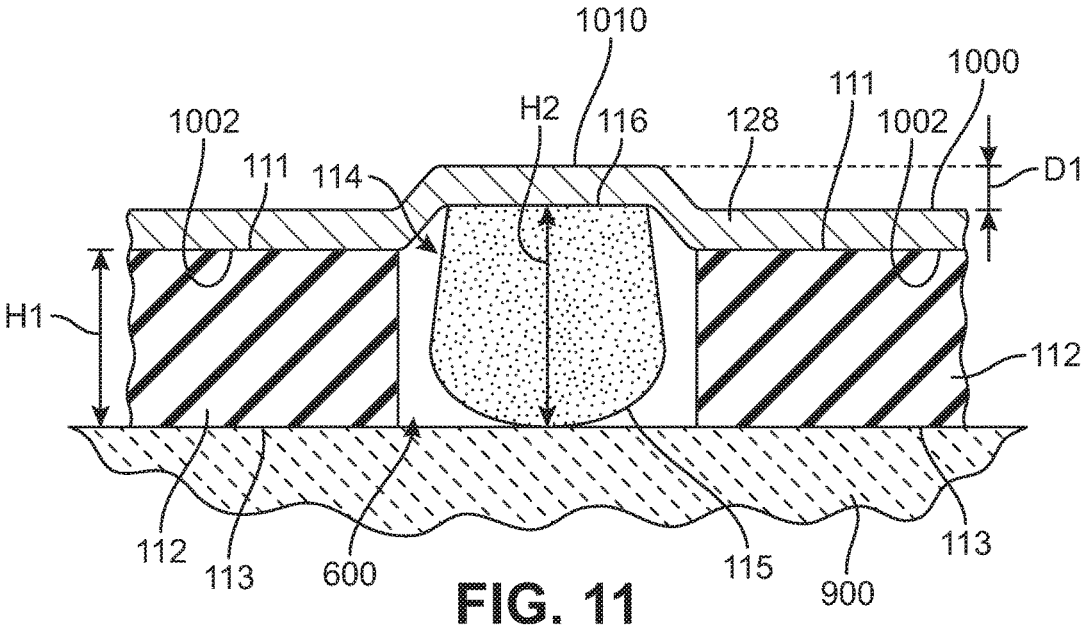
FIG. 11 is an enlarged cross-section view of a sensory node located within an aperture in the sole structure in a compressed condition.

FIGS. 10 and 11 illustrate the isolated motion of an exemplary one of plurality of sensory node elements 114 relative to sole body portion 112 and base layer 128 of bootie 122. Referring now to FIG. 10, sensory node element 114 is located in aperture 600 of sole body portion 112 and moves at least vertically within aperture 600 independently from sole body portion 112. That is, while portions of sensory node element 114 may contact portions of sole body portion 112 when sensory node element 114 moves through aperture 600, sole body portion 112 and sensory node element 114 are not directly joined or attached to each other. With this arrangement, sensory node element 114 is able to wobble and move independently of sole body portion 112 and sensory node element 114 can be displaced vertically relative to outsole surface 113 of sole body portion 112.

In an exemplary embodiment, sole body portion 112 may have a first height H1. First height H1 corresponds to the thickness of sole body portion 112 in the vertical direction extending between the foot of the wearer and the ground. Sensory node element 114 may have a second height H2 that corresponds to the height or thickness of the sensory node element in the same vertical direction. In this embodiment, second height H2 of sensory node element 114 is larger than first height H1 of sole body portion 112. With this arrangement, bottom surface 115 of sensory node element 114 extends above outsole surface 113 of sole body portion 112 such that bottom surface 115 of sensory node element 114 will generally initially contact the ground before outsole surface 113 of sole body portion 112.

In this embodiment, aperture 600 in sole body portion 112 may define an opening in sole body portion 112 that has a first width W1. Sensory node element 114 is located within the opening defined by aperture 600 and has a second width W2. In some cases, where sensory node element 114 has a truncated cone shape, second width W2 may also be a diameter of sensory node element 114. Second width W2 of sensory node element 114 is smaller than first width W1 of the opening defined by aperture 600. With this arrangement, sensory node element 114 may fit within aperture 600 of sole body portion 112 and have at least some clearance with the sides of aperture 600.

In this embodiment, base layer 128 of bootie 122 includes an inner surface 1000 facing towards the interior void of upper 120 and an outer surface 1002 facing away from article 100 and towards the ground. Outer surface 1002 of base layer 128 is attached to upper surface 111 of sole body portion 112 and also attached to top surface 116 of sensory node element 114. In FIG. 10, sensory node element 114 is shown in an uncompressed condition so that top surface 116 is approximately even or flush with upper surface 111 of sole body portion 112. Similarly, in the area of bootie 122 shown in FIG. 10, inner surface 1000 of base layer 128 also has an approximately uniform or even height above both top surface 116 and upper surface 111.

Referring now to FIG. 11, sensory node element 114 is shown in a compressed condition, for example, as described with reference to FIG. 9 above. In the compressed condition, bottom surface 115 of sensory node element 114 contacts ground surface 900 and bottom surface 115 of sensory node element 114 moves closer towards outsole surface 113 of the sole body portion 112. This movement also forces top surface 116 of sensory node element 114 upwards against outer surface 1002 of base layer 128. Sensory node element 114 is permitted to move independently of sole body portion 112 through aperture 600, causing the localized area of base layer 128 that is attached to top surface 116 of sensory node element 114 to be moved upwards to form a raised inner surface 1010 of base layer 128. Raised inner surface 1010 can then contact the underside of a foot of a wearer to provide the sensory feedback about ground surface 900.

Additionally, raised inner surface 1010 can provide the wearer's foot with a "push off" surface for making athletic maneuvers or cutting motions.

In this embodiment, raised inner surface 1010 extends above inner surface 1000 by a first distance D1. First distance D1 is approximately equal to the difference between second height H2 of sensory node element 114 and first height H1 of sole body portion 112. That is, the amount that top surface 116 of sensory node element 114 raises base layer 128 so that raised inner surface 1010 extends above inner surface 1000 when in the compressed condition is approximately the same as the amount that bottom surface 115 of sensory node element 114 extends above outsole surface 113 of sole body portion 112 when article 100 is in the uncompressed condition.

With this configuration, the amount of first distance D1 can be configured as desired based on selection of first height H1, second height H2, or both. For example, in some cases, the distance of raised inner surface 1010 of base layer 128 may be higher or lower to contact portions of the foot of the wearer. Selection of a larger or smaller first height H1 for sole body portion 112 and/or a smaller or larger second height H2 for sensory node element 114 can accommodate different distances needed for raised inner surface 1010 to contact a foot.

Figure 12:
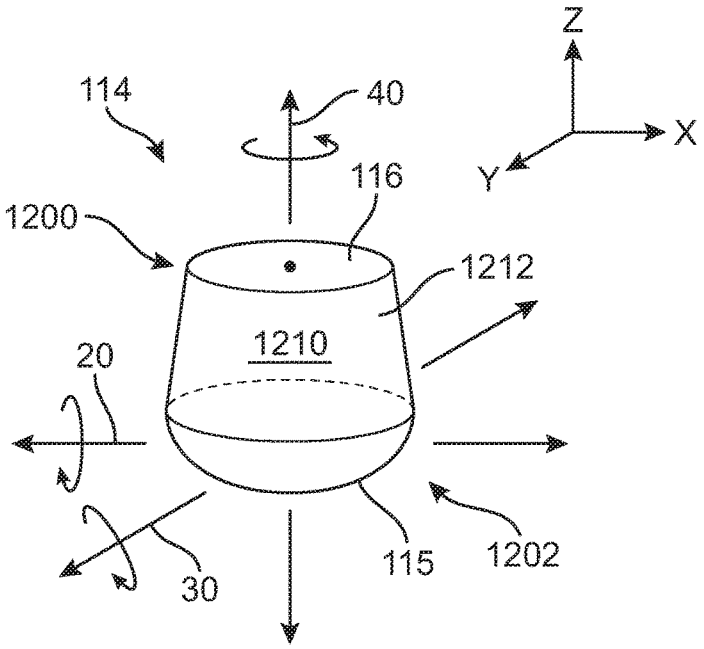
FIG. 12 is a representational view of an exemplary sensory node element.
Figure 13:
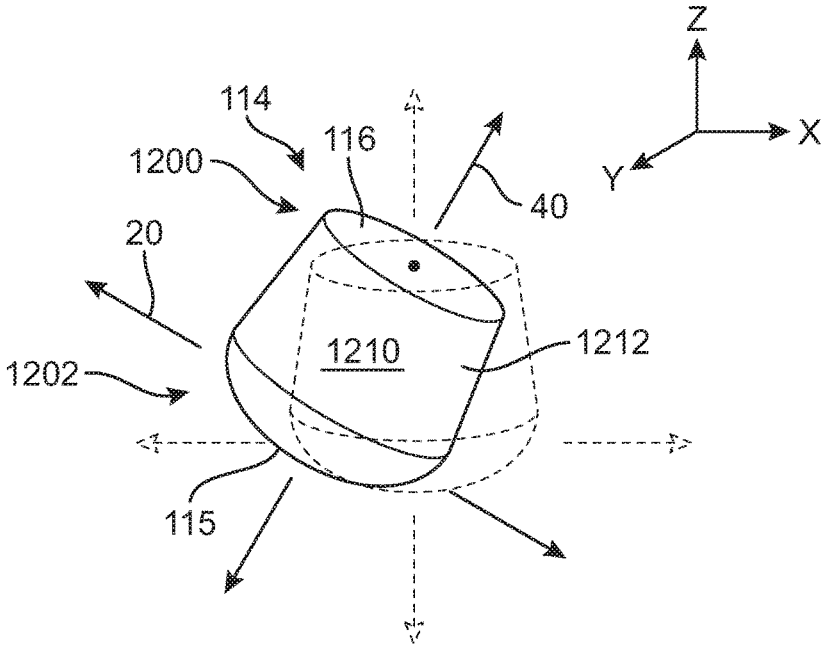
FIG. 13 is a representational view of an exemplary sensory node element wobbling about axes.

FIGS. 12 and 13 illustrate an exemplary embodiment of a representative sensory node element of plurality of sensory node elements 114. In this embodiment, sensory node element 114 includes a top end 1200 where top surface 116 is located and a bottom end 1202 where bottom surface 115 is located. A body portion 1210 of sensory node element 114 extends between top end 1200 and bottom end 1202 and includes a side surface 1212. In one embodiment, top end 1200 has a smaller diameter than the opposite bottom end 1202 so as to define an approximately truncated cone shape of sensory node element 114. In different embodiments, the distance between top end 1300 and bottom end 1302 can vary so as to vary the length of body portion 1310 and, thereby, the height of sensory node element 114. In an exemplary embodiment, bottom surface 115 of sensory node element 114 is convex. In one embodiment, bottom surface 115 of sensory node element 114 may be approximately hemispherical. In other embodiments, however, the shape of sensory node element 114 may vary, including, but not limited to triangular, cylindrical, spherical, round, and other geometric and non-geometric shapes. Additionally, in other embodiments, bottom surface 115 may be flat or uneven.

In this embodiment, the truncated cone shape of sensory node element 114 and convex bottom surface 115 allow sensory node element to wobble about at least two axes. As shown in FIG. 12, sensory node element 114 has a first axis 20 aligned approximately with an x-axis, a second axis 30 aligned approximately with a y-axis, and a third axis 40 aligned approximately with a z-axis. In some embodiments, sensory node element 114 can wobble or move about two or three of first axis 20, second axis 30, and/or third axis 40. In some cases, the x-axis may be associated with a lateral direction of article 100, the y-axis may be associated with a longitudinal direction of article 100, and the z-axis may be associated with a vertical direction of article 100. It should be understood, however, that the designation and selection of coordinate systems may be varied.

For example, as shown in FIG. 13, sensory node element 114 is shown wobbling about at least two axes so that the orientation of bottom surface 115 and top surface 116 is changed. Wobbling of sensory node element 114 can be caused by the transmission of forces or instability of the ground surface relative to article 100. With this configuration, sensory node elements 114 can wobble about at least two axes within apertures 600 in the sole body portion 112 to transmit sensory feedback to a foot of a wearer.

In previous embodiments, base layer 128 of bootie 122 is shown attached to top surface 116 of sensory node element 114 and upper surface 111 of sole body portion 112. In some cases, outer surface 1002 of base layer 128 can be attached to upper surface 111 of sole body portion 112 up to the edge of the opening defining apertures 600. For example, as shown in FIGS. 10 and 11. In other cases, a predetermined amount of slack or give to accommodate the upwards vertical motion of top surface 116 of sensory node element 114 may be provided to base layer 128 by keeping a portion of outer surface 1002 of base layer 128 unattached to upper surface 111 of sole body portion 112.

Figure 14:
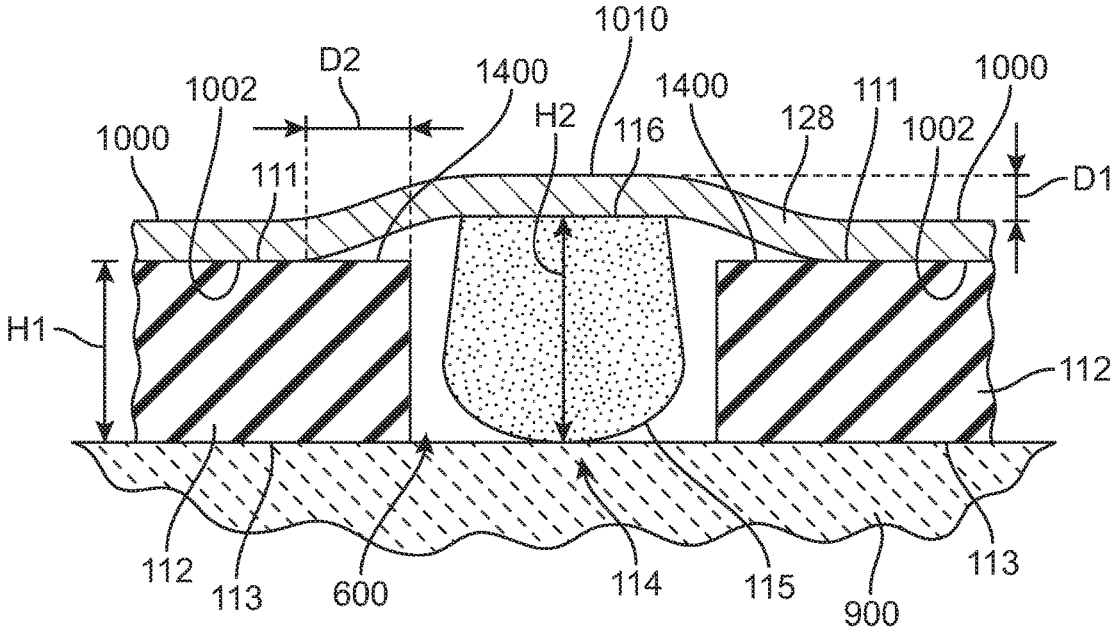
FIG. 14 is an enlarged cross-section view of an alternate embodiment of a sensory node located within an aperture in the sole structure.

Referring now to FIG. 14, outer surface 1002 of base layer 128 remains unattached to upper surface 111 of sole body portion 112 along a margin 1400 located at a predetermined distance D2 surrounding apertures 600 in sole body portion 112. Margin 1400 permits base layer 128 to have a predetermined amount of slack or give to accommodate the upwards vertical motion of top surface 116 of sensory node element 114 when in the compressed condition. As shown in FIG. 14, margin 1400 extending predetermined distance D2 around aperture 600, allows inner surface 1000 of base layer 128 to rise to raised inner surface 1010.

In some embodiments, base layer 128 may be formed from a flexible or stretchable layer or membrane, including materials made of elastic, rubber, woven or knit textiles, or other suitable flexible materials. In such cases, base layer 128 may stretch as needed to accommodate the upwards vertical motion of top surface 116 of sensory node element 114 when in the compressed condition. Additionally, such flexible or stretchable layer may be resilient to assist with forcing sensory node element 114 back to the uncompressed condition when force from a foot has been removed. However, in other embodiments, base layer 128 may need to accommodate additional displacement or increased sensitivity that may be lost if using a material that is too resilient. Additionally, in other embodiments, base layer 128 may be made from a non-stretchable or inflexible material. Accordingly, in these other embodiments, the alternate embodiment of attaching base layer 128 to upper surface 111 of sole body portion 112 using margin 1400, as described in reference to FIG. 14 above, may assist with upwards vertical motion of top surface 116 of sensory node element 114 when in the compressed condition.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

What is claimed is:

1. A sole structure for an article of footwear, the sole structure comprising:

a sole body portion, the sole body portion including an outsole surface facing away from the article of footwear and an upper surface disposed opposite the outsole surface; and a plurality of sensory node elements disposed within apertures in the sole body portion, the apertures defining at least a portion of a lateral side perimeter edge and a medial side perimeter edge of the sole structure;

each of the plurality of sensory node elements including a bottom surface configured to engage a ground surface and a top surface disposed opposite the bottom surface;

the bottom surface of each of the sensory node elements extending below the outsole surface of the sole body portion when the sensory node element is in an uncompressed condition; and wherein each of the plurality of sensory node elements are configured to move vertically within the apertures in the sole body portion so that the bottom surface of the sensory node element moves closer towards the outsole surface of the sole body portion when the sensory node element is in a compressed condition, wherein the sole body portion extends between respective ones of the plurality of sensory node elements on the lateral side perimeter edge and respective ones of the plurality of sensory node elements on the medial side perimeter edge, the sensory node elements on the lateral perimeter side extending laterally beyond the lateral side perimeter edge of the sole structure and the sensory node elements on the medial side perimeter edge extending medially beyond the medial side perimeter edge of the sole structure.

2. The sole structure according to claim 1, wherein the top surface of each sensory node element is attached to a base layer; and wherein the base layer is attached to the upper surface of the sole body portion.

3. The sole structure according to claim 2, wherein the base layer remains unattached to the upper surface of the sole body portion at a predetermined distance surrounding the apertures in the sole body portion.

4. The sole structure according to claim 1, wherein each of the sensory node elements is unattached to the aperture.

5. The sole structure according to claim 1, wherein each of the sensory node elements has an approximately truncated cone shape.

6. The sole structure according to claim 5, wherein the bottom surface of the sensory node elements is convex.

7. The sole structure according to claim 1, wherein the plurality of sensory node elements are located in at least portions of a forefoot region, a midfoot region, and a heel region along each of the lateral side perimeter edge and the medial side perimeter edge of the sole structure.

8. The sole structure according to claim 7, wherein the plurality of sensory node elements extend further toward a toe end of sole structure on the medial side perimeter edge than on the lateral side perimeter edge.

9. An article of footwear, the article of footwear comprising:

an upper; and a sole structure joined to the upper, the sole structure comprising:

a sole body portion, the sole body portion including an outsole surface facing away from the article of footwear and an upper surface disposed opposite the outsole surface, the sole body portion having apertures that define at least a portion located along portions of a lateral side perimeter edge and a medial side perimeter edge of the sole structure; and a plurality of sensory node elements disposed within the perimeter-defining apertures in the sole body portion and extending outwardly beyond the lateral side perimeter edge and the medial side perimeter edge of the sole structure;

each of the plurality of sensory node elements including a bottom surface configured to engage a ground surface and a top surface disposed opposite the bottom surface;

the bottom surface of each of the sensory node elements extending below the outsole surface of the sole body portion when the sensory node element is in an uncompressed condition; and the top surface of each of the sensory node elements extending towards an interior of the upper above the upper surface of the sole body portion when the sensory node element is in a compressed condition.

10. The article of footwear according to claim 9, wherein the top surface of each sensory node element is attached to a base layer; and wherein the base layer is attached to the upper surface of the sole body portion.

11. The article of footwear according to claim 10, wherein the base layer is a portion of the upper.

12. The article of footwear according to claim 10, wherein the base layer is an insole.

13. The article of footwear according to claim 9, wherein the base layer is a flexible material that permits the plurality of sensory node elements to move vertically relative to the outsole surface of the sole body portion.

14. The article of footwear according to claim 10, wherein each of the sensory node elements is attached to the base layer in a spaced-apart configuration to permit independent movement of the sensory node elements.

15. The article of footwear according to claim 9, wherein the plurality of sensory node elements are located in at least portions of a forefoot region, a midfoot region, and a heel region along each of the lateral side perimeter edge and the medial side perimeter edge of the sole structure.

16. The article of footwear according to claim 15, wherein the plurality of sensory node elements extend further toward a toe end of sole structure on the medial side perimeter edge than on the lateral side perimeter edge.

* * * * *